United States Patent [19]

Bart

[11] Patent Number: 4,643,418

[45] Date of Patent: Feb. 17, 1987

[54] EXERCISE TREADMILL

[75] Inventor: Gordon B. Bart, Sturgis, Mich.

[73] Assignee: Battle Creek Equipment Company, Battle Creek, Mich.

[21] Appl. No.: 708,004

[22] Filed: Mar. 4, 1985

[51] Int. Cl.[4] ..... A63B 23/06

[52] U.S. Cl. ..... 272/69; 198/856

[58] Field of Search ..... 272/69, DIG. 6; 198/856; 200/61.43, 61.42, 52 R, 86 R; 119/29; D21/192

[56] References Cited

U.S. PATENT DOCUMENTS

| | | | |
|---|---|---|---|
| D. 283,239 | 4/1986 | Smith et al. | D21/192 |
| 1,919,627 | 7/1933 | Fitzgerald | 272/69 |
| 2,589,220 | 3/1952 | Buckeridge | 198/856 |
| 3,606,320 | 9/1971 | Erwin, Jr. | 272/69 |
| 3,643,943 | 2/1972 | Erwin, Jr. et al. | 272/69 |
| 3,703,284 | 11/1972 | Hesen | 272/69 |
| 3,711,812 | 1/1973 | Cherry | 338/200 |
| 3,731,917 | 5/1973 | Townsend | 272/69 |
| 3,826,491 | 7/1974 | Elder | 272/69 |
| 4,088,856 | 5/1978 | Tebben | 200/61.42 |
| 4,364,556 | 12/1982 | Otte | 272/69 |
| 4,462,523 | 7/1984 | Kerr | 198/856 |

OTHER PUBLICATIONS

"Tapeswitch" Industrial User Catalog C-4, pp. 1, 6, Tapeswitch Corp. of America.

*Primary Examiner*—Richard J. Apley
*Assistant Examiner*—S. R. Crow
*Attorney, Agent, or Firm*—Irvin L. Groh

[57] ABSTRACT

A safety interlock for an electric exercise treadmill having an electric powered tilt motor for varying the inclination of the exercise surface. The interlock protects the area below the treadmill frame when the treadmill is being used in an inclined position. Perimeter switches around the bottom of the frame are actuated by objects or body members moving under the frame to interrupt power to the treadmill and tilt motors. A safety restarting sequence assures the safety of the user.

10 Claims, 4 Drawing Figures

EXERCISE TREADMILL

This invention relates to electric exercise treadmills, and more particularly to electric treadmills having means for varying the inclination of the exercise surface to vary the exercise effort for a given operating speed and time, and to a safety interlock for such a variable incline treadmill.

With the increasing use of exercise devices for therapeutic and conditioning purposes, there are a number of electric driven treadmills available, some of which have manual or power driven inclination systems taking advantage of the fact that the exercise effort, or aerobic effect, can be varied greatly with small changes in inclination. For example, a 7 percent grade doubles the aerobic or cardiovascular effect over level walking or running exercise.

The powering of a treadmill with an electric drive has brought about the development of some power failure interlocks to protect the user, but heretofore no attention has been given to protection of third persons, particularly children, when the equipment is in use. With the elevation of the treadmill from the support floor to produce an inclination of the exercise surface, a new hazard has been introduced. It is to the protection or safety interlocking of such inclined treadmills that the present invention is directed.

It is, therefore, the primary objective of this invention to supply interlock protection for an electric treadmill when it is being used in an inclined position to interrupt power and operation when an object or body member passes under the raised portion of the equipment.

In accordance with the present invention, protection is supplied for an inclined treadmill by perimeter protection switch means which is attached to the lower portion of the treadmill frame. Circuitry interconnects the perimeter switch to interrupt the power to the treadmill drive motor and the tilt mechanism motor when the switch is activated. Further, interlock control circuitry assures that the equipment cannot be reactivated until the object causing activation has been removed and the equipment is completely returned to the starting off position so that the user has the protection of starting at a zero speed condition.

The electric exercise treadmill has a frame structure which supports an endless belt providing the exercise surface on its top side. The treadmill is powered by an electric drive motor which imparts motion to the belt, and an electric powered tilt mechanism for changing the inclination of the exercise surface. The motors and actuating mechanisms are concealed and protected by the main frame, and the user upon stepping on to the exercise surface has a control panel for safety initiating use of the equipment. The control panel has a key operated on-off switch which provides the initial protection against unauthorized use. Also presented on the control panel is a speed control dial for setting the desired belt speed in miles per hour, a toggle switch for raising or lowering the exercise surface and an emergency stop switch which may be actuated by pushing. The control panel may also have a timing module which can be operated in an elapsed time mode or preset time countdown mode. An inclination meter is displayed on the top portion of the frame so that at any time the user can observe his inclination and the degree to which he is changing it.

The tilt mechanism is located at the forward end of the treadmill so that to provide the desired angle of inclination, the forward end of the frame is raised with the rear end remaining stationary at floor level. This elevates the forward end and the two side areas of the frame providing access between the frame and the floor underneath. A line contact or tape switch is attached to the lower edge of the frame members at both sides and the forward end, so that if an object or body member moves under the frame, it will contact this perimeter switch at any point that it enters this protected area.

The interlock protection system which is activated by the perimeter switch includes the main key operated power switch, the speed control for selecting the speed of the electric drive motor, a reset speed switch, which may be attached to the shaft of the speed control, and which is activated when the speed control is set to zero, a power relay, and an interlock relay. The interconnecting circuitry is such that the main switch enables the power relay to supply power to the drive motor and to the tilt mechanism through normally open power relay contacts. The power relay remains enabled through energization of its coil by power passing through the main switch and through normally open power relay contacts, through normally closed interlock relay contacts to the power relay coil. The main switch further enables power to be supplied to the normally open contacts of the perimeter switches and then to the coil of the interlock relay. The main switch supplies power to a 24 volt transformer to reduce the voltage supplied to the perimeter switches. There are three separate switches, one on each side frame member and one on the front frame member, and these three switches are connected in parallel so that energization of any one of the three switches will cause power to be supplied to energize the coil of the interlock relay opening its normally closed contacts and interrupting power to the coil of the power relay which de-energizes to interrupt power to the drive motor and to the tilt mechanism by opening of the normally open power relay contacts. Once contact has been made with one of the perimeter switches, power remains interrupted by the self-latching energization of the interlock relay coil which closes a normally open interlock relay contact supplying power to the interlock relay coil. Power cannot be restored until the perimeter switches have been deactivated by opening of its normally open contact by removal of the object causing activation. The restarting sequence can then be initiated by first turning the main power switch off to de-energize the coil of the interlock relay by interrupting the power to the 24 volt transformer. This closes the normally closed contact of the interlock relay. The main power switch is then turned on and the speed control is set to zero which closes the normally open reset speed switch. The circuitry initially supplies power to the main relay coil through the closed main switch and the closed reset speed switch through normally closed main relay contacts and normally closed interlock relay contacts to the main relay coil. Upon the actuation of the speed control for selecting the operating speed, the reset speed switch opens, but the coil of the main relay remains energized through power from the main power switch to the closed normally open power relay contacts and the normally closed contacts in the interlock relay.

The preferred embodiments of the invention are illustrated in the drawing in which.

Figure 1:
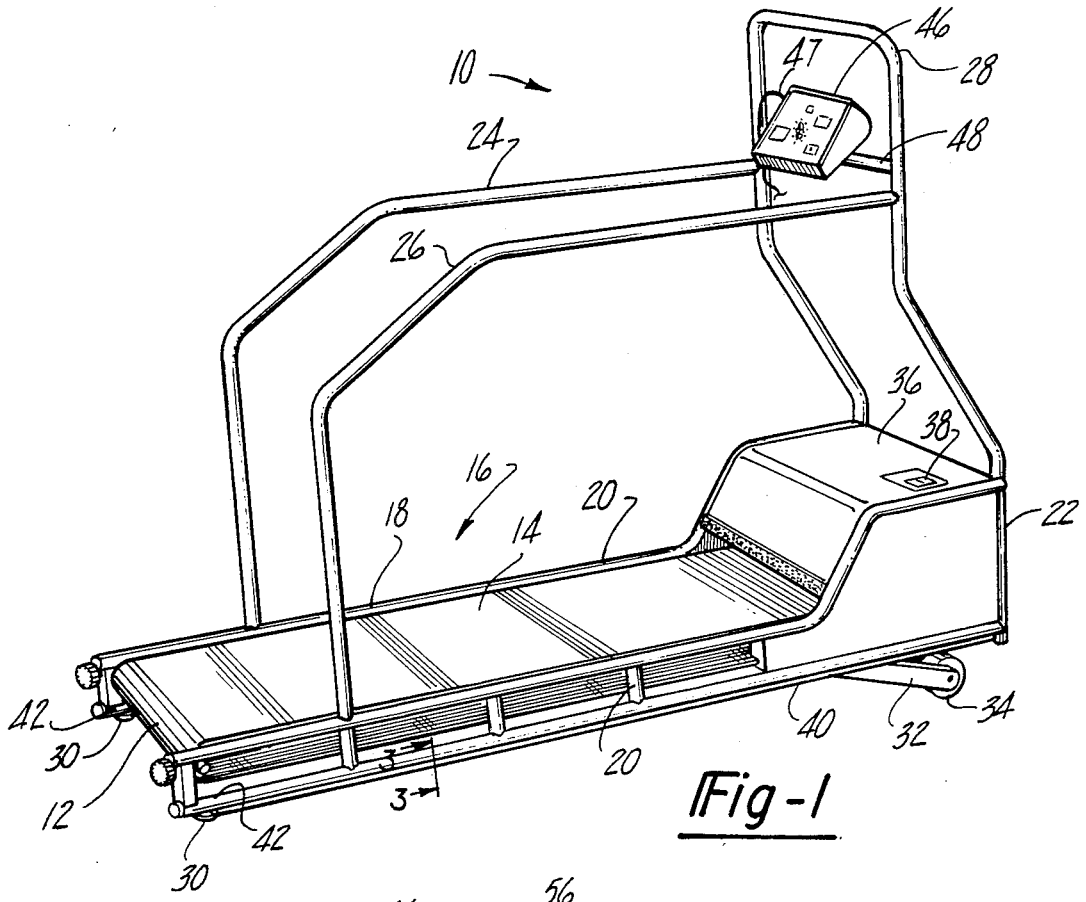
FIG. 1 is a perspective view of the electric treadmill in an inclined position which has been constructed to incorporate the interlock control system of the invention.

The electric treadmill embodying the invention is shown generally at 10 and includes an endless belt 12 having an exercise surface 14. The belt 12 is supported for movement within frame 16 which includes side members 18 and 20 and front member 22. Frame 16 has attached thereto side hand rails 24 and 26 and front handle 28 which is also attached to the hand rails. The rear of the frame 16 is supported on feet 30 attached to the lower rear extremities of side members 18 and 20. The forward end of frame 16 is supported by subframe 32 terminating in rollers 34. The subframe 32 is pivoted to frame 16 in a manner to provide elevation of the front end of the frame by the actuation of a screw jack tilt mechanism, all of which is not shown but is confined within the cabinet 36. Also confined within cabinet 36 is the belt drive motor and the control circuitry, more fully shown in FIG. 4. Mounted in the top of cabinet 36 for easy viewing by the user is inclinometer 38 which shows the grade or elevation of the exercise surface in 1 percent increments.

Figure 3:
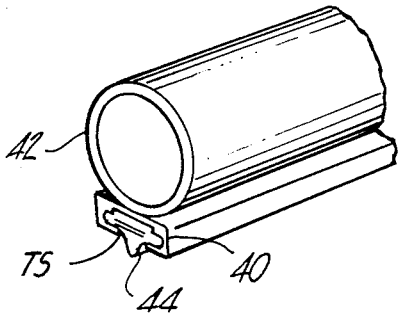
FIG. 3 is a sectional view taken along line 3—3 of FIG. 1 showing the details of the perimeter switch.

The perimeter protection sensor or switch means of the present invention preferably takes the form of individual line or tape switches TS 1, TS 2, and TS 3 located at the bottom of side frame members 18, 20 and front frame member 22, respectively. Specifically, the switches are confined within channel members 40 attached to the lower rails 42 of frame 16 as shown in FIG. 3. Each tape switch, TS, has a bead 44 running its entire length which protrudes a short distance out of channel 44 so that any contact with the bead will close the normally open switch. A finger force of only 8 ounces exerted anywhere along the length of the switch is all that is necessary for closure. Tape switches TS 1 and TS 2 run the entire length of side members 18 and 20 from feet 30 to the front member 22 and tape switch TS 3 extends between tape switches TS 1 and TS 2 so that any object or body member passing under the frame 16 will come in contact with and close one of the switches. These tape or ribbon switches are commercialy available items. It should be understood that the perimeter switches could take other forms such as electric eye or laser beams trained along the corresponding edges to be protected. Also, microswitches can be used in conjunction with spring loaded cables mounted along the lower frame edges.

Figure 2:
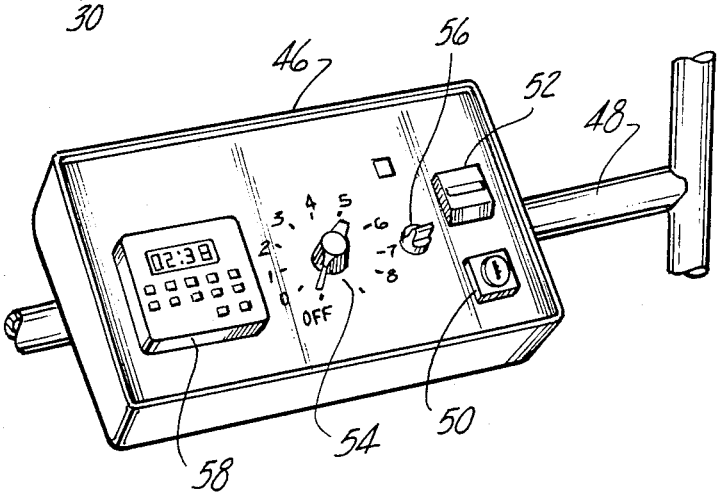
FIG. 2 is a perspective view of the control panel showing the speed control and switches incorporated in the invention.

When the user steps on the exercise surface 14 of endless belt 12, he has ready access to the control panel 46 for commencing operation of the equipment. Control panel 46 is conveniently mounted on cross bar 48 of front handle 28. Control panel 46 is connected to the motor and circuitry which i controls by cable 47 leading into cabinet 36. Referring to FIG. 2, the control panel is shown in more detail to include a main power switch in the form of key operated switch 50 and an emergency push button switch 52 to instantaneously stop operation of the equipment. The emergency switch 52 is illuminated when the key switch is turned on to indicate that power is being supplied to the unit. Speed control 54 is in the form of a potentiometer or rheostat and has a graduated scale to set the speed of the motor driving the endless belt and hence the exercise surface. The scale of the speed control is graduated from zero to nine miles per hour. In its extreme counterclockwise position, the speed control 54 passes the zero miles per hour position to an "off" position which actuates a reset speed switch not shown in FIG. 2. Tilt switch 56 is a toggle switch which is pushed in its upward position to raise the exercise surface or is pushed in its lower position to lower the exercise surface, as is clearly indicated on the panel. Finally, the control panel contains a timer module 58 which can be actuated to display the elapsed time, or a pre-set time can be set so that the timer counts down upon pushing of its start button.

In operation, the speed control 54 should be in its off position terminating the last use of the equipment. The main power switch cannot be turned on until the key is inserted as the switch actuator. If the speed control 50 has not been turned to its off position, prior to turning on the main switch 50, the equipment will not respond until the speed control has been turned past its zero speed position to the off position. The emergency push button switch 52 will light up and show when the power has been turned on by the main power switch 50. Once the power has been established by turning the main switch on when the speed control is in the off position, the speed control dial is turned past zero to the desired speed. The angle of inclination can be changed by actuation of toggle switch 56 while observing the reading on inclinometer 38 positioned on the top of cabinet 36. The grade can be adjusted from zero at a level condition to a maximum of 17 percent, and the inclinometer reads in units of 1 percent. There is a limit switch at the low, zero percent, level and at the high, 17 percent inclination, to stop the operation of the tilt mechanism. The tilt mechanism will automatically stay in the position to which it has been raised or lowered upon the release of the toggle tilt switch. The tilt mechanism cannot be operated unless the key main switch is on. The treadmill is normally turned off by turning the speed control past zero to its off position. Pressing the emergency switch, or turning the key off will also stop both the treadmill movement and the tilt mechanism. When the equipment has been turned off by movement of the speed control to the off position or by actuation of either the emergency stop switch or the main key operated power switch, or by a power failure or pulling of the main power cord, the starting sequence must again be used to operate the equipment.

Figure 4:
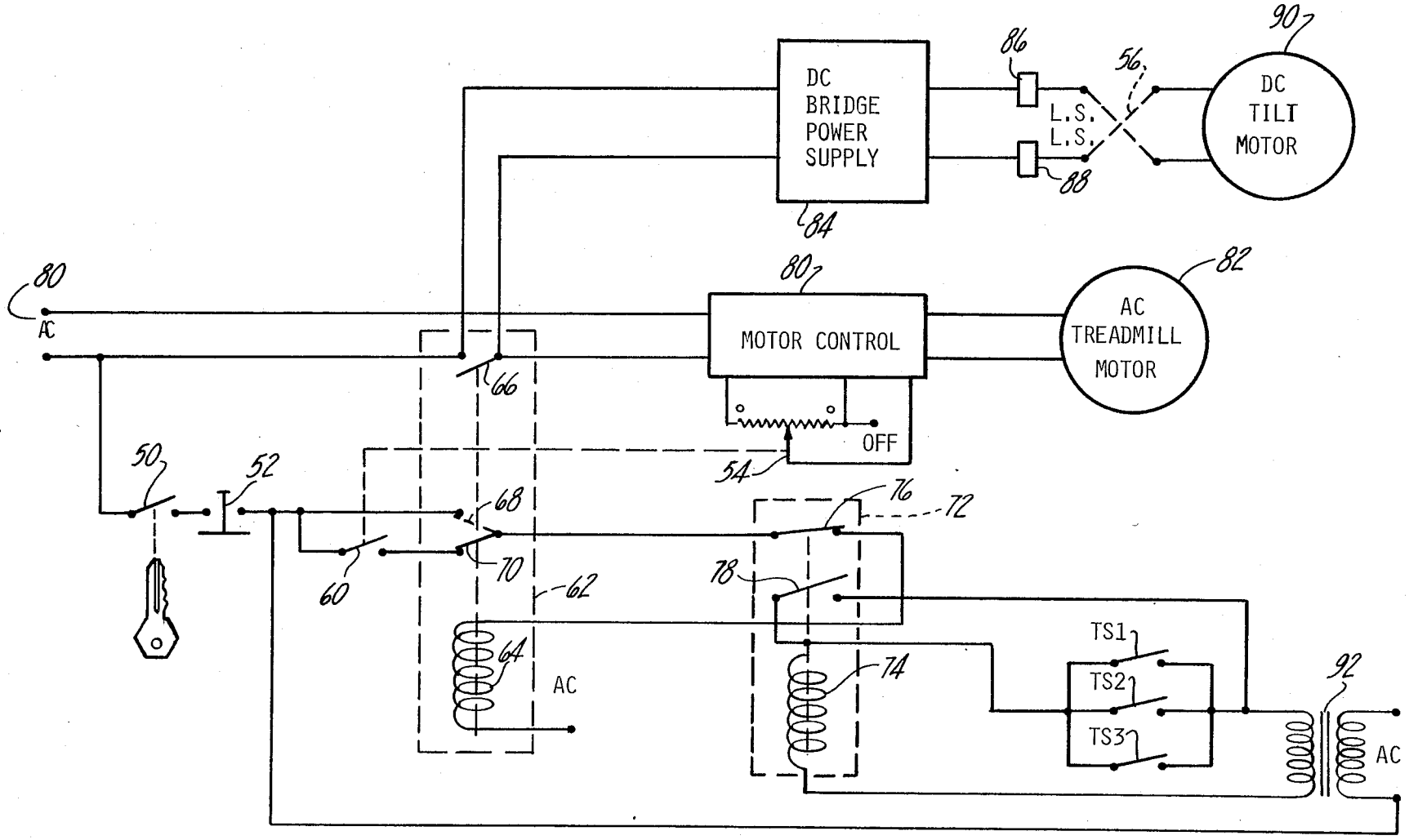
FIG. 4 is a schematic wiring diagram showing the interlock circuitry of the present invention.

Referring to FIG. 4, the schematic wiring diagram shows the interlock circuitry with the switches shown in their normal state, for example, main key switch 50 is shown in its normally open state, emergency push-button switch 52 is shown in its normally closed state, and reset speed switch 60 is shown in its normally open state with a mechanical linkage indicated to speed control potentiometer 54. Likewise, power relay 62 is shown with its coil 64 and its associated normally open contacts 66, normally open contacts 68 and normally closed contacts 70, and interlock relay 72 is shown with its coil 74 and its associated normally closed contacts 76 and its normally open contacts 78.

In operation, speed control potentiometer 54 would be set to its off position closing the normally open reset speed switch 60 to supply 115 volt AC power from source 80 through normally open key operated main switch 50 through normally closed emergency push button switch 52, closed normally open reset speed switch 60, normally closed power relay contacts 70 and normally closed interlock relay contacts 76 to the coil 64 of power relay 62 to thereby energize it. In this state, AC power is supplied from source 80 through the closed normally open contacts 66 of power relay 62 to motor control 80 and AC treadmill drive motor 82. Likewise, AC power is supplied through closed normally open power relay contacts 66 to DC bridge power supply 84 which in turn will supply DC power through high and low limit switches 86 and 88 and toggle tilt switch 56 to DC tilt motor 90. The operator the selects the desired speed for the treadmill by moving speed control 54 which opens reset speed switch 60. Power relay 62 remains energized to continue to supply power to the treadmill motor 82 and tilt motor 90 through closed normally open contact 66 by power supplied through normally open power relay contact 68 and normally closed interlock relay contact 76 to relay coil 64.

The angle of inclination of the exercise surface 14 can be varied by the operator by actuation of toggle tilt switch 56 which is a double pole, double throw, three position switch. Limit switch 86 cuts the power to toggle switch 56 when the high limit of 17 percent grade is reached by the tilt motor 90 when toggle switch 56 is in its raising position, and power is also cut off by lower limit switch 88 when the level condition is reached (0 percent grade) when the toggle switch 56 is in the lowering position.

The perimeter interlock system is kept in a state of readiness by the 115 volt AC power supply through main switch 50, emergency switch 52 to the primary of 24 volt transformer 92 to normally open tape switches TI 1, TS 2 and TS 3 which are arranged in parallel to 24 volt coil 74 of interlock relay 72. The lower voltage is used in the tape switches to eliminate the shock hazard of a 115 volt circuit. When an object passes under the inclined frame 16 and closes one of the tape switches TS 1, TS 2 or TS 3, current is supplied to the interlock relay coil 74 opening normally closed contacts 76 interrupting power to coil 64 of power relay 62, thus deenergizing the relay and opening normally open contact 66 which interrupts power to the AC treadmill motor 82 and the tilt motor 90. Interlock relay 72 remains energized even though the tape switch which closed is opened through the closed normally open interlock relay contacts 78. This assures that the complete starting cycle must be instituted in order to restore power and operation. Additionally, the main key switch must be first turned off to open the circuit through emergency switch 52 to the primary of 24 volt transformer 92 to the latched in coil 74 of interlock relay 72.

It will be readily apparent that the relays and hard wiring of the described circuit can be replaced by equivalent integrated circuitry and microprocessor control without departing from the spirit of the invention as set forth in the preferred embodiment.

The embodiments of the invention in which an exclusive property or privilege is claimed are defined as follows:

1. In an electric exercise treadmill having a frame structure with longitudinal sides and forward and rear ends supporting an endless belt providing an exercise surface, said frame being supported from a floor surface at its forward and rear ends, an electric drive motor for moving said belt and an electric power tilt mechanism attached to said frame structure for raising the forward end of said exercise surface to change the inclination of said exercise surface from a floor level position to an elevated position, an interlock control system, comprising, in combination: an automatic perimeter protection switch means attached to the bottom of said frame along said longitudinal sides and forward end so that said switch means superposes said floor surface in close proximity thereto, preventing actuation thereof when said exercise surface is parallel to said floor surfaces, and said switch means is exposed for actuation when said exercise surface is in said elevated position; and circuitry interconnecting said perimeter switch means to supply power to said drive motor and said tilt mechanism and for interrupting said power upon the activation of said perimeter switch means by an object moving under said frame when said exercise surface has been elevated by said tilt mechanism.

2. The interlock control system of claim 1 wherein said perimeter protection switch means includes a line contact switch mounted along the bottom of said frame.

3. The interlock control system of claim 2 wherein said switch means includes individual line contact switches mounted along the bottom of each longitudinal side of the frame and an individual switch mounted along the bottom of the forward end of said frame, all three switches being connected in parallel so that activation of any of the three switches will interrupt said power.

4. The interlock control system of claim 1, further comprising: a main power switch; a speed control for selecting the speed of said electric drive motor; a reset speed switch; a power relay; and an interlock relay; said main switch enabling said power relay by means of said circuitry to supply power to said drive motor and said tilt mechanism through closed normally open power relay contacts, said power relay remaining enabled through energization of its coil by power passing through said main switch, through normally open power relay contacts, through normally closed interlock relay contacts to said power relay coil, said main switch further enabling power to be supplied to the normally open contacts of said perimeter switch means and then to the coil of said interlock relay, whereby upon actuation of said perimeter switch means closing normally open contacts, power is supplied to energize the coil of said interlock relay opening said normally closed interlock relay contacts thereby interrupting power to the coil of said power relay and de-energizing it to thereby interrupt power to said drive motor and said tilt mechanism by opening said normally open power relay contacts, said power being restored and operation resumed after said perimeter switch has been de-activated by opening its normally open contact by first turning said main power switch off to deenergize the coil of said interlock relay, closing its normally closed contacts and then turning on the main power switch and setting said speed control to zero which closes said normally open reset switch, said circuitry initially supplying power to said main relay coil through said closed main switch and closed reset speed switch through normally closed main relay contacts and normally closed interlock relay contacts to said main relay coil, and upon the actuation of said speed control for selecting the operating speed, and the consequent opening of said reset speed switch, the coil of said main relay remains energized through power from said main power switch to said closed normally open power relay contacts and the normally closed contacts in said interlock relay.

5. The interlock control system of claim 4 wherein the main switch enables power to be supplied to the normally open contacts of said perimeter switch by means of supplying power to the primary of a voltage reducing transformer supplying a reduced voltage to the normally open contacts of said perimeter switch and then to the coil of said interlock relay.

6. The interlock control system of claim 5 wherein said interlock relay is self-latching upon energization of its coil by the actuation of the perimeter switch which closes a normally open interlock relay contact through which said reduced voltage flows to said interlock relay coil.

7. The interlock control system of claim 4 wherein said electric power tilt mechanism is powered by a DC motor and power is supplied to said motor through a DC bridge power supply to which the main switch supplies AC power.

8. The interlock control system of claim 7 further comprising a reversing switch between said DC motor and said DC bridge power supply for selectively changing the polarity of DC power supplied to said DC motor for increasing or decreasing the angle of inclination of said exercise surface.

9. The interlock control system of claim 8 further comprising limit switches in the power lines between the DC bridge power supply and said reversing switch to interrupt power to said DC tilt motor when the angle of inclination is being decreased by actuation of said reversing switch and said inclination reaches zero and for interrupting power to said DC motor at a preset inclination when said reversing switch is actuated to increase the angle of inclination.

10. The interlock control system of claim 4 further comprising a push button emergency stop switch for interrupting power to said drive motor and said tilt mechanism, said emergency switch being downstream of said main switch, having normally closed contacts in said circuitry to said normally open and normally closed main relay contacts and in the circuitry supplying power to said perimeter switch.

* * * * *